US011585065B2

(12) United States Patent
Kowalchuk

(10) Patent No.: US 11,585,065 B2
(45) Date of Patent: Feb. 21, 2023

(54) VADIR BARRIER: A CONCRETE SLAB UNDERLAYMENT WITH ALL-IN-ONE VOID FORM, AIR BARRIER, DRAINAGE PLANE, INSULATION AND RADON PROTECTION

(71) Applicant: Jonathan Kowalchuk, Orcadia (CA)

(72) Inventor: Jonathan Kowalchuk, Orcadia (CA)

( * ) Notice: Subject to any disclaimer, the term of this patent is extended or adjusted under 35 U.S.C. 154(b) by 119 days.

(21) Appl. No.: 16/700,398

(22) Filed: Dec. 2, 2019

(65) Prior Publication Data

US 2020/0217038 A1 Jul. 9, 2020

(30) Foreign Application Priority Data

Jan. 8, 2019 (CA) ..... CA 3029299

(51) Int. Cl.

| | |
|---|---|
| ***E02D 27/01*** | (2006.01) |
| ***E02D 27/34*** | (2006.01) |
| ***E02D 31/00*** | (2006.01) |
| ***E02D 27/32*** | (2006.01) |

(52) U.S. Cl.

CPC ..... *E02D 31/008* (2013.01); *E02D 27/01* (2013.01); *E02D 27/32* (2013.01); *E02D 27/34* (2013.01); *E02D 2300/0046* (2013.01)

(58) Field of Classification Search

CPC ..... E02D 31/008; E02D 27/01; E02D 27/32; E02D 2300/0046; E02D 31/08; E02D 27/34

USPC ..... 52/169.14, 169.8

See application file for complete search history.

(56) References Cited

U.S. PATENT DOCUMENTS

| | | | | | |
|---|---|---|---|---|---|
| 1,172,710 | A * | 2/1916 | Howe | B32B 3/28 | 52/410 |
| 3,086,899 | A * | 4/1963 | Ingraham | E04C 2/3405 | 428/158 |
| 3,445,322 | A * | 5/1969 | Saiia | E02D 31/02 | 428/443 |
| 3,561,177 | A * | 2/1971 | Agro et al. | E02B 3/126 | 52/169.14 |
| 4,167,598 | A * | 9/1979 | Logan | E04B 1/803 | 428/34.1 |
| 4,565,468 | A * | 1/1986 | Crawford | E02D 31/06 | 405/38 |
| 4,880,333 | A * | 11/1989 | Glasser | E02B 11/00 | 405/43 |
| 4,917,933 | A * | 4/1990 | Schluter | E04B 1/762 | 428/167 |

(Continued)

*Primary Examiner* — Phi D A

(74) *Attorney, Agent, or Firm* — Kyle R Satterthwate; Ryan W Dupuis; ADE & Company Inc.

(57) ABSTRACT

A concrete slab underlayment product is used at an excavation area at which a concrete foundation slab is to be poured. The underlayment combines a vapour barrier layer with a set of foam insulation bodies. The vapour barrier layer spans fully over the entire set of foam insulation bodies, which are spaced apart from one another at least at lower ends thereof opposite the vapour barrier layer. This leaves drainage/air spaces open between the foam insulation bodies when laid in an installed position atop the floor of an excavated area. In use under a concrete slab, the vapour barrier layer forms a gas and moisture barrier, and the foam insulation bodies and the drainage/air spaces therebetween form a combination of void spaces, drainage channels and insulation blocks between the concrete slab and the floor of the excavation area.

26 Claims, 5 Drawing Sheets

(56) References Cited

U.S. PATENT DOCUMENTS 4,925,342 A * 5/1990 Hendy ..... E02B 11/00 405/36
4,943,185 A * 7/1990 McGuckin ..... E02B 11/00 405/38
4,945,697 A * 8/1990 Ott ..... E04F 15/02 404/31
5,173,344 A * 12/1992 Hughes ..... C09K 3/10 405/107
5,187,915 A * 2/1993 Alexander ..... E04C 2/528 52/169.14
5,255,482 A * 10/1993 Whitacre ..... E04F 15/18 52/385
5,473,847 A * 12/1995 Crookston ..... E04C 2/205 454/260
5,572,842 A * 11/1996 Stief ..... E04F 15/02429 52/144
5,692,348 A * 12/1997 Ambrosino ..... E04B 1/70 405/43
5,775,039 A * 7/1998 McPherson ..... E04B 1/7023 52/746.1
5,788,413 A * 8/1998 Peggs ..... E02D 31/02 405/129.6
5,899,031 A * 5/1999 Nagaoka ..... E02D 19/18 52/169.5
6,241,421 B1 * 6/2001 Harvie ..... E02B 11/00 405/36
7,698,858 B2 * 4/2010 Schroer ..... E04H 9/145 405/36
8,347,575 B2 * 1/2013 Bierwirth ..... E04F 15/182 52/403.1
8,438,806 B2 * 5/2013 Lim ..... E04F 15/02 52/302.1
8,695,300 B2 * 4/2014 Hartl ..... E04F 15/182 52/390
8,955,278 B1 * 2/2015 Mills ..... E04B 5/48 52/302.3
9,359,766 B2 * 6/2016 Shiao ..... E04B 1/80
9,828,740 B1 * 11/2017 Brown ..... E02D 33/00
10,011,990 B2 * 7/2018 Collins ..... E04C 2/06
10,774,544 B2 * 9/2020 Hayes ..... E01C 3/006
2005/0210772 A1 * 9/2005 Janesky ..... E02D 31/02 52/168
2007/0175112 A1 * 8/2007 Janesky ..... E02D 31/002 52/169.5
2012/0247040 A1 * 10/2012 Buoni ..... E04F 13/04 52/302.1
2015/0376895 A1 12/2015 Fox

* cited by examiner

FIG. 10
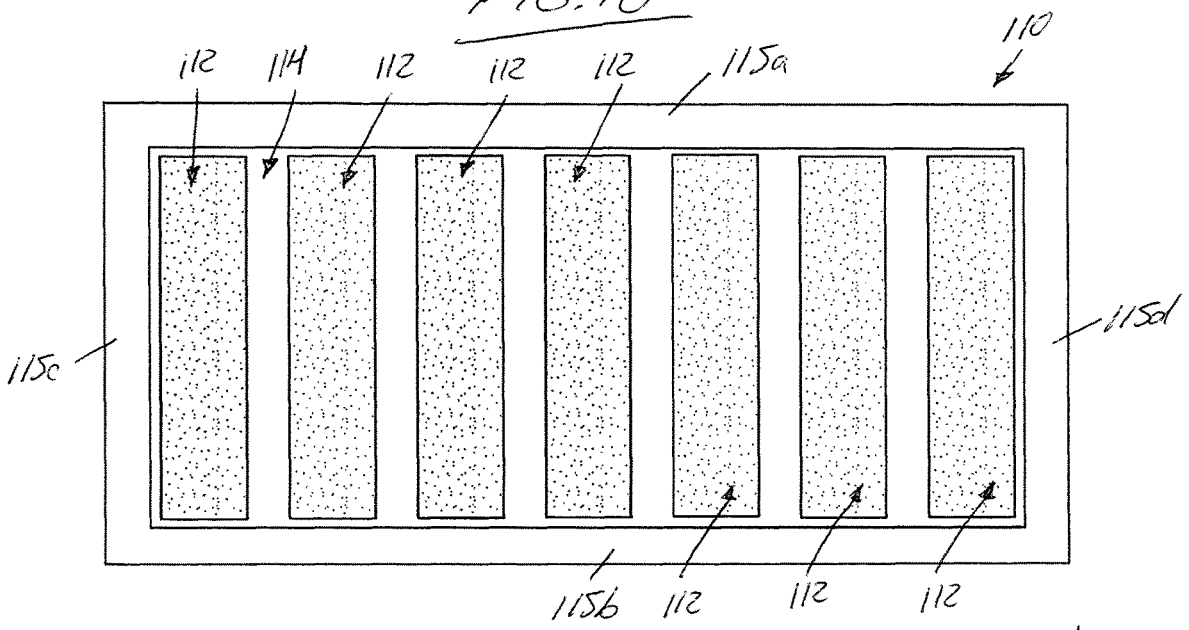
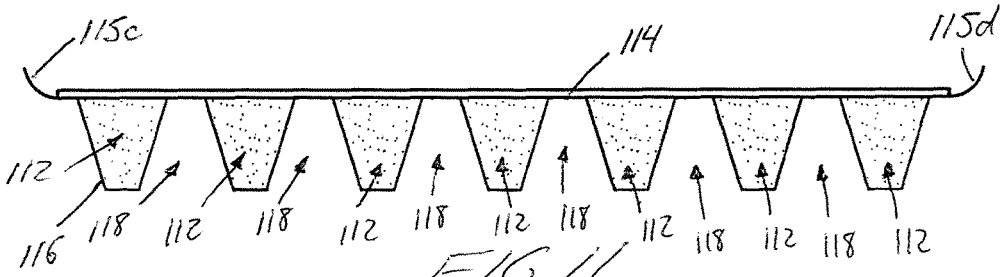
FIG. 11
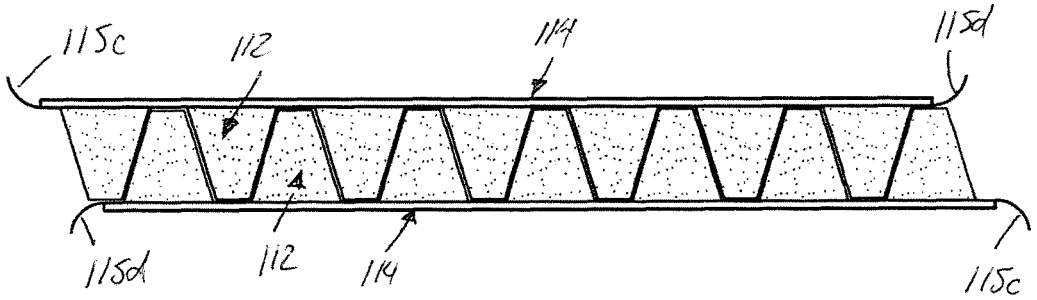
FIG. 12

VADIR BARRIER: A CONCRETE SLAB UNDERLAYMENT WITH ALL-IN-ONE VOID FORM, AIR BARRIER, DRAINAGE PLANE, INSULATION AND RADON PROTECTION

CROSS-REFERENCE TO RELATED APPLICATIONS

This application claims benefit under 35 U.S.C. 119(a) of Canadian Patent Application No. 3,029,299, filed Jan. 8, 2019, the entirety of which is incorporated herein by reference.

FIELD OF THE INVENTION

The present invention relates generally to building foundation construction techniques, and more specifically to products and techniques used in preparation of excavated areas in which concrete foundation slabs are to be poured in-situ.

BACKGROUND

In construction of concrete foundations, void forms are employed for the purpose of creating voids in the underside of a concrete slab to accommodate swelling of expansive soil therebeneath, which otherwise can cause shifting and cracking of the slab. Existing void form products are typically block or box-shaped units formed of carboard, or a solid foam material such as expanded polystyrene. Such void form units are individually laid out over the floor of the excavated area in an appropriate pattern or array, followed by an overlay of hardboard placed atop the void form units, and a final layer of vapour barrier sheeting placed atop the hardboard. The concrete slab is then poured atop the vapour barrier sheeting. A shortcoming of cardboard void forms is the potential for premature degradation or collapse thereof if exposed to rainwater or other excessive moisture before the concrete is poured. Shortcomings of foam void forms include typically greater cost, environmental impact, and their lightweight nature making them susceptible to potential disruption in windy environments.

Regardless of the particular material composition of the void forms and the associated drawbacks thereof, the preparation of the area before paying the concrete is an inefficient multi-step process involving the placement of individual void forms in a first layer, followed by separate placement of subsequent hardboard and vapour barrier layers.

Accordingly, there remains room for improvements and alternatives concerning preparatory techniques for in-situ pouring of concrete slab foundations.

SUMMARY OF THE INVENTION

According to one aspect of the invention, there is provided a concrete slab underlayment for use at an area at which an in-situ concrete slab is to be poured, said underlayment comprising:

an upper vapour barrier layer comprising at least one material that is substantially impermeable to gas and vapour; and a set of insulation bodies that are materially distinct from the at least one material of the upper vapour barrier layer, and are secured to said upper vapour barrier layer in underlying relation thereto at a central non-margin area thereof;

wherein said upper vapour barrier layer spans fully over all of said insulation bodies, said insulation bodies are spaced apart from one another at least at lower ends thereof opposite the upper vapour barrier layer to leave drainage/air spaces open between the lower ends of said insulation bodies when laid in an installed position atop a floor surface of said area; and wherein said at least one material of the upper vapour barrier layer comprises flexible sheeting, at least at outer margins of said upper vapour barrier layer that reside along respective perimeter edges of the vapour barrier layer outside the central non-margin area occupied by the insulation bodies;

whereby in use in said installed position under a concrete slab poured over said underlayment, the vapour barrier layer forms a gas and moisture barrier beneath said concrete slab, and the insulation bodies and the drainage/air spaces therebetween form a combination of void spaces, drainage channels and insulation blocks between said floor surface and said concrete slab.

Preferably said insulation bodies comprise recycled foam.

According to another aspect of the invention, there is provided a method of preparing an area for an in-situ concrete slab, said method comprising:

(a) atop a floor surface of said area, laying down a plurality underlayments of the forgoing type; and (b) sealing together the vapour barrier layers of said plurality of underlayments at the outer margins thereof to create a gapless span of said vapour barrier layers across said floor surface.

BRIEF DESCRIPTION OF THE DRAWINGS

Preferred embodiments of the invention will now be described in conjunction with the accompanying drawings in which:

FIG. 10 is a bottom plan view of a second embodiment of the concrete slab underlayment.

FIG. 11 is a side elevational view of the underlayment of FIG. 10.

FIG. 12 is a side elevational view of two underlayments of the type shown in FIGS. 10 and 11 stacked together in inverted and intermeshing fashion for space efficient transport and storage before installation.

DETAILED DESCRIPTION

Figure 1:
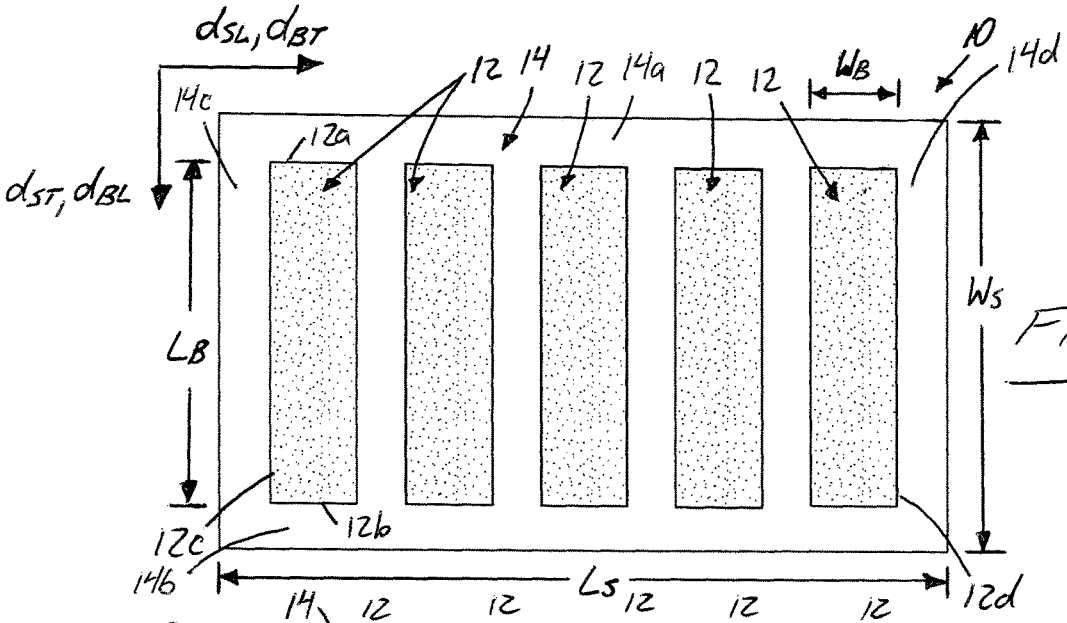
FIG. 1 is an overhead plan view of a concrete slab underlayment according to one embodiment the present invention.

FIG. 1 shows an overhead plan view of a concrete slab underlayment product 10 for placement on a floor surface of an excavated area prior to in-situ pouring of a concrete slab thereover. The underlayment product 10 features a plurality of solid foam insulation bodies 12 secured to, and preferably encapsulated within, flexible sheeting of appropriate thickness and relative impermeability to serve as an effective barrier against water vapour, air and radon gas. The foam insulation bodies are preferably composed of recycled expanded polystyrene (colloquially, "styrofoam"), though non-recycled foam material, whether expanded polystyrene or otherwise, could alternatively used. Plastic vapour barrier sheeting made of polyurethane, polyethylene or other polymeric material is known and commercially available, and so particular compositional details thereof are not described herein in further detail. Plastic sheeting of notable thickness may be used to provide a robust, rip-resistant product, particularly since the plastic sheeting bears the weight of the foam insulation bodies secured thereto. The plastic sheeting may have a thickness between 6-mil and 24-mil, and in some embodiments has a thickness greater than 10-mil, preferably between 12-mil and 24-mil. Like the foam insulation bodies, the plastic sheeting may be composed partially or fully from recycled materials, and may comprise multiple sheets sealed together to form a laminated sheet of greater thickness than the individual sheets from which it is composed. While the above examples of poly film are commonly used vapour barriers, other polymers, including elastomers (e.g. natural or synthetic rubber rubber), may be used. Likewise, non-polymeric sheeting of suitable impermeability and flexibility may be used in place of polymeric options.

The plastic sheeting includes an upper sheet 14 of elongated rectangular shape that defines a vapour barrier layer that overlies the entire set of solid foam bodies 12, which are arranged in a single-row linear array at the underside of the upper sheet 14. The upper sheet 14 has two long edges lying parallel to one another in a longitudinal sheet direction $d_{SL}$, and two shorter edges lying parallel to one another and perpendicular to the elongated edges in a transverse sheet direction $d_{ST}$. A length of the sheet $L_S$ is thus measured between the two shorter edges in the longitudinal sheet direction $d_{SL}$, while a shorter width $W_S$ of the sheet is measured between the two long edges in the transverse sheet direction $d_{ST}$. The entirety of the upper sheet is a continuous, unperforated sheet lacking any openings therein.

Each solid foam body 12 is of also of elongated shape, thus having a length $L_B$ that is measured axially of the body and exceeds both a width $W_B$ and thickness $T_B$ of the body. However, the elongated direction of each foam body is oriented perpendicularly transverse to the elongated direction of the upper sheet. Accordingly, the length $L_B$ of each solid foam body is measured in a longitudinal body direction $d_{BL}$ that lies perpendicular to the longitudinal sheet direction $d_{SL}$ and parallel to the transverse sheet direction $d_{ST}$. The width of each solid foam body $W_B$ is measured in a transverse body direction $d_{BT}$ that lies perpendicularly to the longitudinal body direction $d_{BL}$ and the transverse sheet direction $d_{ST}$, and parallel to the longitudinal sheet direction $d_{SL}$. The thickness $T_B$ of each solid foam body 12 is measured in a depth direction $d_D$ that is perpendicular to both the longitudinal and transverse body directions $d_{BL}$, $d_{BT}$.

Figure 2:
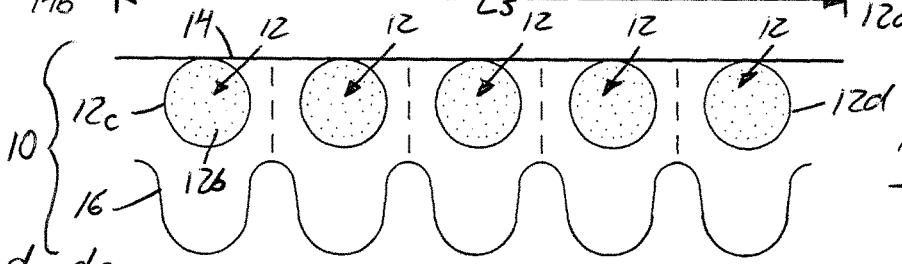
FIG. 2 is a partially exploded side elevational view of the underlayment of FIG. 1.

The width $W_S$ of the upper sheet exceeds the length $L_B$ of the equally sized foam bodies, and the set of foam bodies are centered between the long edges of the upper sheet in the transverse sheet direction $d_{ST}$, whereby the upper sheet 14 overhangs each foam body 12 at both longitudinal ends 12*a*, 12*b* thereof. The length $L_S$ of the upper sheet 14 exceeds an overall width $W_O$ of the set of foam bodies 12, as measured longitudinally of the upper sheet from an outer side 12*c* of a first foam body nearest to a first longitudinal end of the sheet to an outer side 12*d* of a last foam body nearest to the opposing second longitudinal end of the sheet. In the instance of FIGS. 1 and 2, where the foam bodies are entirely separate and space from one another, and thus have unoccupied gaps therebetween in the longitudinal sheet direction, this overall width of the set of foam bodies is the sum of the individual widths $W_B$ of the foam bodies, plus the sum of the gap widths between the foam bodies. The set of foam bodies 12 are centered between the short edges of the upper sheet in the longitudinal sheet direction $d_{SL}$, which together with the excess sheet length relative to the overall body width, means that the upper sheet overhangs the outer sides 12*c*, 12*d* of the first and last foam bodies. The upper sheet thus overhangs the set of foam bodies on all sides thereof, whereby the upper sheet features an overhanging outer margin 14*a*, 14*b*, 14*c*, 14*d* along each of its four perimeter edges. These overhanging outer margins can be used to join together multiple underlayments during installation of the product, as described in more detail further below.

In the preferred embodiment shown in the drawings, the foam bodies are encapsulated within the plastic sheeting. Accordingly, in addition to optional bonding of the topsides of the foam bodies 12 to the underside the upper sheet 14, a lower sheet 16 of the same polymeric sheeting material is attached to the upper sheet 14 in a position spanning beneath the set of the foam bodies 12 in order to encapsulate the foam bodies between the upper and lower sheets 14, 16. In the illustrated example, a singular unitary lower sheet 16 spans fully across the full set of foam bodies in both the longitudinal and transverse sheet directions and is attached to the upper sheet at all four outer margins 14*a*, 14*b*, 14*c*, 14*d* thereof.

With reference to FIG. 2, the lower sheet 16 in the illustrated example is also attached to the upper sheet 14 in the gaps between the separate foam bodies 12 so that the lower sheet wraps upwardly between the foam bodies to maintain the gaps as open drainage spaces 18 in the final installation of the underlayment, as described in more detail below. Each attachment of the lower sheet 16 to the upper sheet 14 at the outer margins of the upper sheet and at the gaps between the foam bodies may be accomplished by heat sealing of the upper and lower sheets 14, 16 to one another, whether using radio frequency welding, ultrasonic welding, or other heat-sealing techniques, for example depending on the material composition of the sheeting. Rather than direct bonding through a heat welded seam, the sheets may be attached together by a separate adhesive product, for example a flowable glue adhesive or rolled tape adhesive, the latter of which may be a peel-and-stick adhesive tape with a single-sided or double-sided adhesive strip whose one or more adhesive sides are initially covered by one or more respective protective strips.

As an alternative to a singular unitary lower sheet 16 spanning the entire set of foam bodies, smaller lower sheets each encapsulating a respective subset of the foam bodies may be employed. In one such example, individual lower sheets each encapsulate a respective one of said foam bodies. The foam bodies may be secured to the plastic sheeting solely by the encapsulated state thereof between the upper and lower plastic sheets, or may feature additional bonding of the foam bodies to the sheeting itself by a suitable bonding agent. In other embodiments, encapsulation of the foam bodies by one or more lower sheets may be omitted, with the foam bodies being held in place solely by bonded connection to the upper sheet. In the illustrated embodiment, the polymeric sheeting is transparent or translucent, hence the visibility of the foam bodies through the upper and lower sheets in the drawings.

Figure 3:
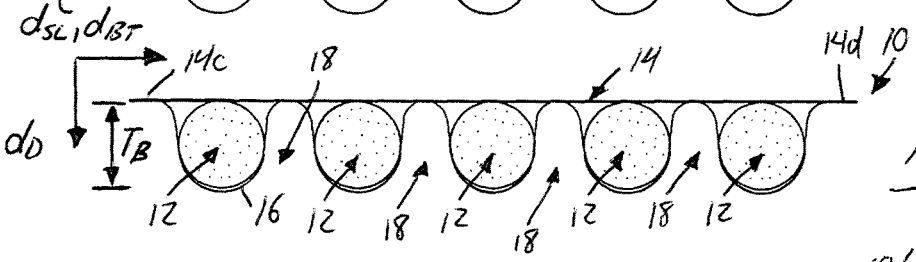
FIG. 3 is an assembled side elevational view of the underlayment of FIG. 2.

FIGS. 2 and 3 show the foam bodies as having circular cross-sectional shape in planes lying normal to the longitudinal body direction $d_{BL}$, but it will be appreciated that any variety of cross-sectional shapes may be employed. The variants in FIGS. 4 and 5 illustrates two such variants, which also demonstrate that the foam bodies need not be entirely separate and spaced apart entities.

Figure 4:
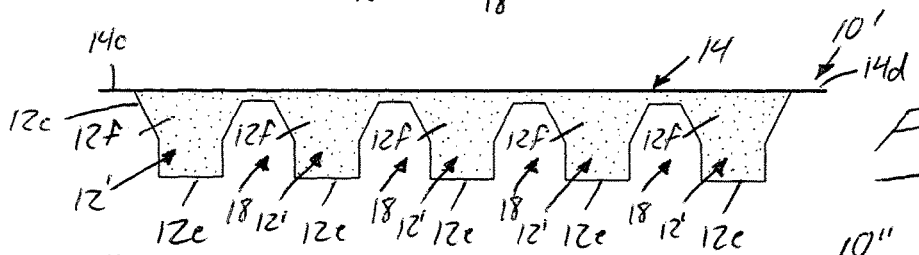
FIG. 4 is an assembled side elevational view illustrating a variant of the cross-sectional shape of the underlayment of FIG. 3.

Instead, two or more adjacent foam bodies may be integral sections of a larger solid foam unit, as demonstrated by the FIG. 4 underlayment 10' in which the full set of foam bodies 12' are all integrally defined by a singular, monolithic foam unit encapsulated in, and/or bonded to, the plastic sheeting. Here, each foam body 12' is downwardly tapered in width over at least a portion of its thickness so that lower ends 12*e* of the foam bodies lying furthest from the upper sheet 14 are narrower than the top ends of the foam bodies that directly underlie the upper sheet in adjacent or bonded relation thereto. This way, a gap space is still left between each adjacent pair of foam bodies at the tapered regions 12*f* and narrowed lower ends 12*e* thereof to create the aforementioned drainage space 18. Meanwhile, the wider upper ends of the foam bodies 12' are integrally joined to one another at the underside of the upper sheet 14, thus bridging the foam bodies together as a monolithic unit.

Figure 5:
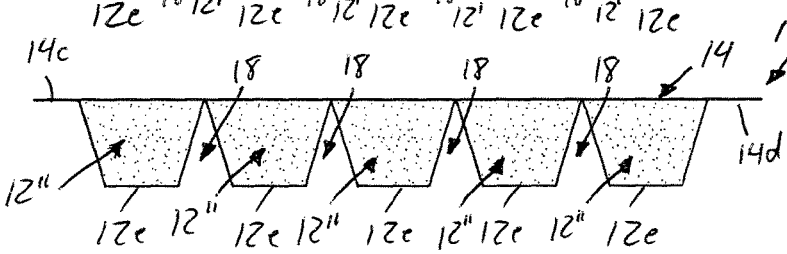
FIG. 5 is an assembled side elevational view illustrating another variant of the cross-sectional shape of the underlayment of FIG. 3.

FIG. 5 illustrates another variant of the underlayment 10" where the foam bodies 12" are again tapered to define narrowed lower ends at which the gap spaces reside to create the drainage spaces 18 between the foam bodies, like in FIG. 4. However, in FIG. 5, the foam bodies are separate individual foam bodies rather than part of a larger monolithic unit like that of FIG. 4. However, unlike the separately spaced foam bodies in FIGS. 1 and 2, the wider upper ends of the foam bodies 12" in FIG. 5 reside in abutted contact with one another at the underside of the upper sheet. In the FIG. 5 variant, the top ends of the foam bodies 12" thus occupy the entire central non-margin area of the upper sheet 14 to maximize the load bearing upper surface area of the underlayment, whereas in FIG. 1, the gaps span all the way from the lower ends of the foam bodies to the underside of the upper sheet, thus leaving non-load-bearing strips of upper sheet's central area unsupported at the gaps between the foam bodies.

Figure 6:
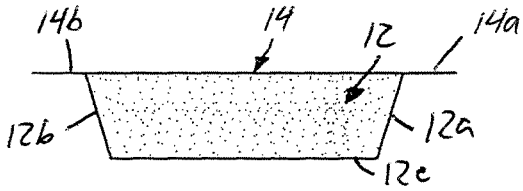
FIG. 6 is an end elevational view of the underlayment of any one of FIGS. 3 through 5.
Figure 8:
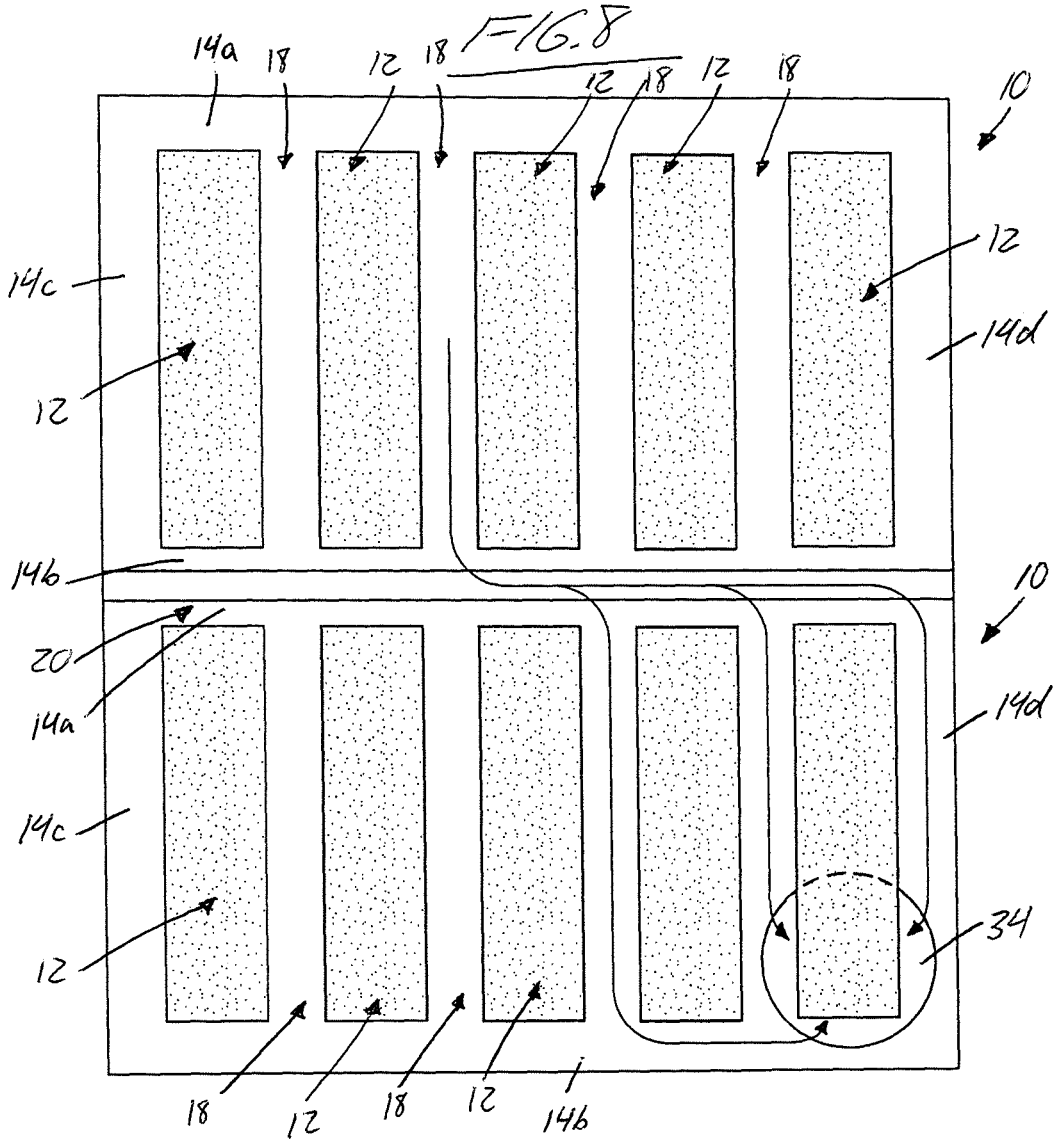
FIG. 8 is an overhead plan view illustrating overlapped placement of two underlayments of FIG. 1 relative to a sump pit during installation of said underlayments to enable water drainage to said sump pit after pouring of a concrete slab atop said underlayments.
Figure 9:
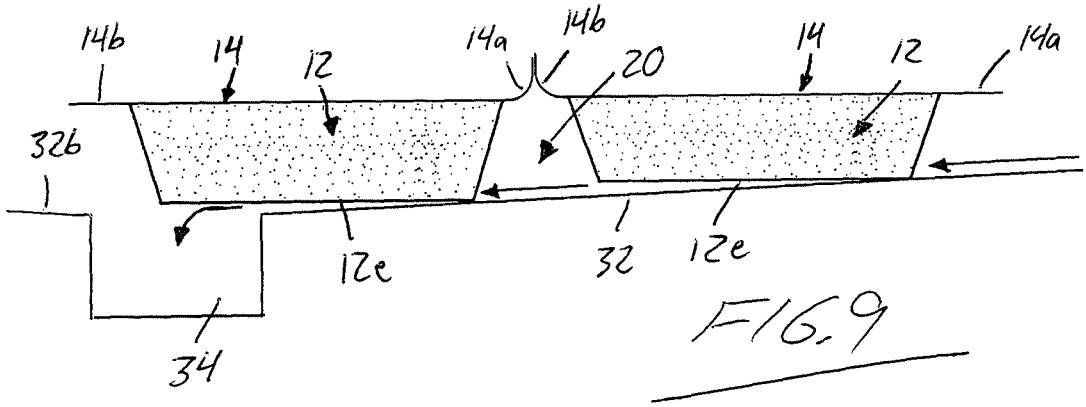
FIG. 9 is an end elevational view illustrating use of overhanging margins of the underlayments of FIG. 8 to seal the two underlayments together during installation prior to pouring of said concrete slab.

Regardless of the cross-sectional shape of the foam bodies 12 and whether they are separately individual bodies or part of a larger monolithic foam unit, each foam body 12 is preferably longer at the bottom end 12*e* thereof than at the top end thereof. This is shown in FIG. 6, where the longitudinal ends 12*a*, 12*b* of each foam body 12 slope downwardly inward in converging fashion to impart a downward taper to the length dimension of the body. This helps ensure that when two underlayments are laid down side by side along the long edges of their upper sheets as shown in FIG. 8, and then joined together at the longitudinal margins 14*a*, 14*b* running along these edges, as shown in FIG. 9, a guaranteed drainage space 20 will be left open between the foam bodies of the two underlayments at the shorter lower ends 12*e* of the foam bodies, even if the longer top ends of the foam bodies are placed in abutting relation during the placement and seaming together of the underlayments.

The flexible upper sheet 14 of the underlayment product allows it to be folded or rolled up in the longitudinal sheet direction into a reduced footprint for transport and storage. FIGS. 1 through 6 show a strip of underlayment having five foam bodies, but the quantity of foam bodies per strip may be varied. For example, the underlayment may be manufactured with a substantial sheet length and substantial quantity of foam bodies thereon, which is then rolled up into a relatively large coil. Later, a distributor, retailer or end-user may unroll the coiled product, and cut the upper sheet in the transverse sheet direction at select intervals to create smaller underlayments strips of reduced foam body count. In the FIG. 4 example, the bridged connections between the integrally defined foam bodies of the monolithic foam unit may are kept relatively thin an flexible to allow temporary folding or rolling of the underlayment for transport and storage before use.

Figure 7:
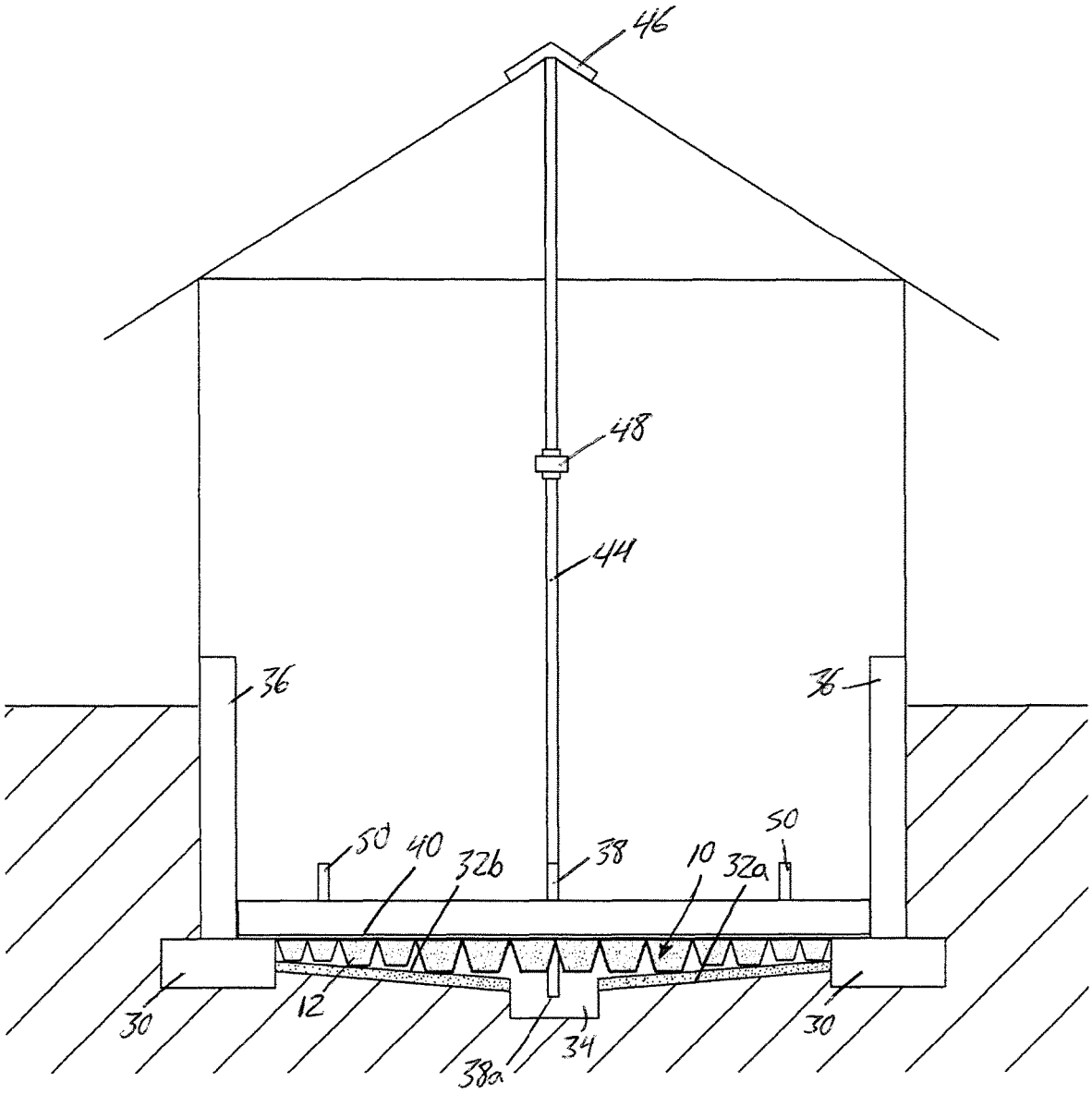
FIG. 7 is a schematic cross-sectional view of a house featuring a concrete foundation produced in accordance with the present invention using underlayments of varying thickness.
Figure 7A:
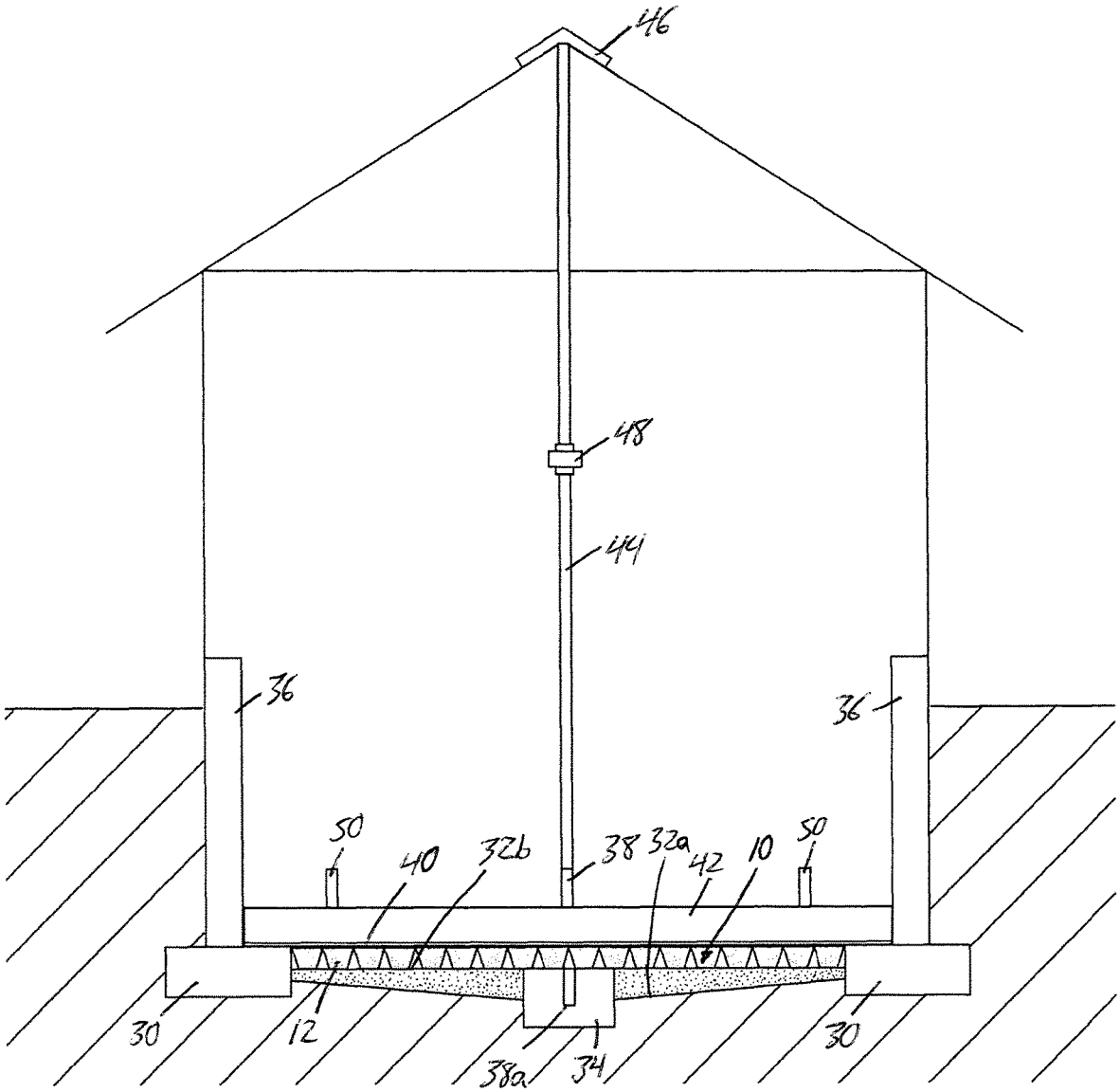
FIG. 7A is a schematic cross-sectional view similar to FIG. 7, but with underlayments of uniform thickness.

FIG. 7 illustrates how underlayments are used during construction of a concrete foundation of a building. First, a site is excavated and concrete footings 30 are laid out around the perimeter of an earthen bottom floor 32*a* of the excavation area, over which for the intended concrete slab is destined. A sump pit 34 is installed in recessed relation to the earthen floor, along with any plumbing or ventilation rough-ins required to service the building. Though the figure shows the sump pit at a center point of the floor surface, the invention is not limited to such central sump placement. One ventilation exhaust rough-in 38 is shown standing upright from the sump pit 34 for reasons described herein further below. The earthen floor is then graded to provide a gradual even slope downwardly from the footed perimeter of the earthen floor surface to the sump pit in all direction. Crushed rock is spread over the earthen floor and then graded, as shown in FIG. 7, or leveled, as shown in FIG. 7A, to form a finished floor surface of the excavated area over which a concrete slab is to be poured. This crushed rock floor surface 32*b* is then compacted with a plate tamper. With the floor surface 32*b* now ready for placement of the underlayment, the upright concrete walls 36 of the foundation can be poured in suitable forms (not shown) erected atop the footings 30.

Once the foundation walls are complete, the floor surface 32*b* is overlaid with a suitable number of underlayments to fully occupy the entire floor surface. In one embodiment, the differently sized underlayments of varying thickness are produced, whereby the end-user can acquire a group of underlayments among which some have thicker foam bodies than others. The different thicknesses can be used to compensate for the slope of the floor surface 32*b* toward the sump pit 34 in the event that a level concrete slab is desired atop the sloped floors surface. FIG. 7 illustrates an example where underlayments of three different thicknesses are used, and are laid out in series of increasing thickness from the outer footings 30 toward the sump pit 34.

For example, on a sloped floor that's 4-inches higher at the footings 30 than at the sump pit 34, one could use using 8-inch thick underlayments at outer regions of the floor surface adjacent the footings 30, 10-inch thick underlayments at mid regions of the floor surface situated intermediately between the footings 30 and the sump pit 34, and 12-inch thick underlayments at inner regions of the floor surface 32*b* adjacent the sump pit 34. In this example, the four-inch rise of the sloped floor surface 32*b* is compensated for by the 4-inch difference in thickness between the 8-inch outer underlayments near the footings and the 12-inch underlayments near the sump pit 34. This minimizes the elevational offset between the upper sheets of the different underlayments to provide a generally level surface for the concrete slab to be poured over.

On the other hand, if its desirable to slope the concrete at the same angle as the floor surface, then the same thickness of underlayment may be used throughout. Alternatively, multiple underlayment thicknesses may be employed where the thickness difference between the outer underlayments adjacent the footings and inner underlayments adjacent the sump pit may be different than the rise of the sloped floor surface to only partially compensate the floor surface slope, thus providing the concrete slab with some degree of slope, but less than the slope of the floor surface. In other instances, where the crushed rock of the floor surface is level rather than at a graded slope, the same uniform underlayment thicknesses can be used throughout. FIG. 7A shows another example, where the same uniform thickness of underlayment is used throughout the excavated area in an example where the earthen floor 32*a* is once again graded to slope downwardly toward the sump pit, but the crushed rock is laid in a non-uniform thickness so that the top floor surface 32*b* of this crushed rock layer is horizontally level.

When laying down the underlayments, care should first to be taken to ensure that the floor surface is relatively flat and free of notable irregularities. Next, from an initially rolled quantity of underlayment, a first strip is unrolled across a perimeter-adjacent outer region of the floor surface from the footing at one end of this region to the opposite footing at the other end of this region. Next, a second strip is unrolled across the floor surface in the same direction and in adjacent parallel relation to the first strip of underlayment. This second strip may likewise span fully across the floor surface from footing to footing if the same underlayment thickness is desired at the second floor region over which the second strip is being laid. Alternatively, the second strip may span only partly across the second floor region if varying underlayment thickness is required thereacross according to the particular grade or slope of the floor surface and the desired concrete slab.

During this placement of the second strip of underlayment, the overhanging longitudinal margins 14*a*, 14*b* of the two underlayment strips are placed in overlapping relation to one another, as shown in FIG. 8. As shown in FIG. 9, the long edges of the upper sheets of the two underlayment strips running along these overlapping margins 14*a*, 14*b* are then lifted up and pinched together to enable the margins 14*a*, 14*b* of the two underlayment strips to be sealed together to create a fluid tight seam between the upper sheets thereof. The degree of overlap between the margins and the placement of the seal are selected to preferably maintain a space between the ends 12*a*, 12*b* of the foam bodies of the two underlayment strips, even at the longer top ends thereof, though as mentioned above the lengthwise taper of the foam bodies ensures the creation of drainage space 20 between the foam bodies of the seamed-together underlayment strips at least at the lower ends 12*e* thereof. FIG. 9 also illustrates the sloping of the floor surface 32*b* downwardly toward the sump pit, and how the different thickness of the sealed-together underlayment strips compensates for this floor slope to place the upper sheets 14 of the two underlayment strips at roughly equal elevation despite seating of the underlayment strips on floor areas of different elevation.

The sealing together of the strips may performed by heat sealing, whether using radio frequency welding, ultrasonic welding, or other heat-sealing techniques, for example depending on the material composition of the sheeting. Rather than direct bonding through a heat welded seam, the sheets may be seamed together by a separate adhesive product, for example a flowable glue/sealant product or rolled tape product, the latter of which may be a peel-and-stick adhesive tape. Accordingly, reference herein to sealed or seamed connection is not limited to heat welded seams.

Such laying of the underlayment strips in overlap with one another and seaming together of the overlapping margins is repeated until the entire floor surface 32*b* is covered, during which holes can be cut through the upper sheet 14 and bores or pieces can be cut through or from the foam bodies 12 wherever necessary to accommodate the rough-ins that sand upright from the floor surface. The upper sheet is sealed to any such rough-in around a full perimeter thereof, for example with a flowable sealant product (e.g. acoustical sealant) or rolled tape product. For any two underlayments laid longitudinally end to end, like those of FIG. 7, as opposed to transversely side by side like those of FIGS. 8 and 9, the same overlapping of upper sheet margins and seaming together of such sheet margins is performed between the underlayment strips, but at the transverse margins 14*c*, 14*d* running along the shorter edges of the upper sheets at the longitudinal ends of the underlayments. The degree of overlap between the margins 14*c*, 14*d* of the two underlayments is again selected to maintain spacing between the foam bodies that border these margins of the two underlayments to leave another drainage space therebetween. Once the entire floor surface 32*b* is covered between the footings 30, and the margins of all the underlayments have been sealed together so that their upper sheets provide a continuous unperforated layer of vapour barrier sheeting over the entire floor surface, the outer perimeter of this collective sheet is sealed to the concrete footings 30 around the perimeter of the floor surface, for example using a bead of flowable glue/sealant product (e.g. acoustical sealant), a single-sided or double-sided tape product (whether peel-and-stick or otherwise), or a combination thereof.

Once the seams between the underlayments and the seals around the rough-ins have been inspected to ensure their integrity against vapour or gas intrusion, a cover layer 40 of greater rigidity than the plastic sheeting and foam bodies of the underlaymentd is laid atop the collective upper sheet of the seamed-together underlayments. This cover layer may comprise hardboard or OSB sheeting, or other relatively rigid sheets or panels. This more rigid cover layer helps evenly distribute the load of the concrete slab, once poured, over the floor-seated foam bodies of the underlayments. The concrete slab 42 is then poured atop the rigid cover layer 40, thus achieving a finished state of the foundation.

The collective sheet formed by the sealed-together upper sheets of the underlayments forms a vapour, air and radon barrier over an entirety of the earthen area beneath the concrete slab. With the foam bodies seated on the floor surface, the drainage spaces 18 left between the foam bodies in the longitudinal sheet direction and the drainage spaces 20 left between the foam bodies in the transverse sheet direction create drainage channels running along the top of the floor surface 32*b* in both the transverse and longitudinal sheet directions, respectively. Accordingly, any water accumulating under the concrete pad 42 can flow in two dimensions into the sump pit 34, as shown with flow arrows in FIG. 8. The foam bodies 12 not only support the slab 42 in spaced relation above the floor to maintain these drainage spaces, but also serve as void forms to accommodate earthen swelling beneath the concrete slab, and also as thermal insulators that inhibit heat transfer between the concrete slab and the ground beneath. In non-limiting examples, the foam bodies may have thicknesses measuring between 2-inches and 12-inches, inclusive; lengths measuring 4-feet to 12-feet, inclusive; an insulation rating of between R10 and R40, inclusive; and a compressive strength measuring between 2 PSI and 50 PSI inclusive.

Referring to FIG. 7, the ventilation exhaust rough-in 38 protruding up from the finished concrete slab 42 is coupled to the bottom end of a ventilation stack pipe 44 that runs up to the roof of a building, where it exhausts through a screened outlet under the protection of a sealed rain cap 46. The bottom end 38*a* of the ventilation exhaust rough-in 38 resides in an air space defined below the collective vapour barrier sheet by the network of fluidly connected drainage channels and the sump pit into which they drain. Accordingly, operation of a fan 48 cooperatively installed with the ventilation stack pipe 44 is operable to induce low pressure conditions in this airspace below the concrete. Accordingly, any radon gas emitted from the soil beneath the concrete slab is contained by the collective upper sheet of the installed underlayments to prevent entry of the radon gas into the interior space of the building, while the fan safely exhausts such radon gas to the ambient outdoor environment. While the illustrated embodiment uses a vertical stack pipe and rooftop outlet, the particular routing and final exit point of this ventilation line may be varied within the scope of the present invention.

In addition to the ventilation exhaust rough-in 38 through which radon gas is exhausted, the rough-ins may include ventilation inlet rough-ins 50 whose lower ends likewise reside in the air space defined below the collective vapour barrier sheet, but whose upper ends open into the interior space of the building above the concrete slab. Either prior to their installation or thereafter, these ventilation inlet rough-ins 50 are equipped with one-way check valves allowing downflow through these rough-ins 50, but preventing upflow therethrough. Radon gas can thus not flow upwardly into the interior space of the building, but indoor air from the interior space of building can be drawn down into the air space below the concrete slab when sufficient pressure reduction is induced therein by operation of the fan 48 in the ventilation stack 44. In the illustrated example, the ventilation inlet rough-ins 50 are situated near the outer perimeter of the floor area near the footings, for example near outer corners of the concrete slab, so that the indoor air induced into the air space flows inwardly toward the more centrally located ventilation exhaust rough-in 38 and connected ventilation stack 44. However, it will be appreciated that the particular placement of the check-valved inlet rough-ins 50 may vary relative to the building footprint and the ventilation stack.

The underlayment product may be referred to as a VADIR barrier, of which the acronym denotes the multi-function capabilities of the product: Void form, Air barrier, Drainage creation, Insulation and Radon protection. An acronym is VIPAR: Void form, Insulation, Poly barrier, Aquatic drainage, and Radon protection. All such functions are achieved through laying out of a singular underlayment product over the earthen floor of the excavated area, thus notably reducing the labour requirements compared to conventional foundation preparation methodologies. Placement of each individual strip of underlayment automatically places a plurality of foam void forms in adjacent or appropriately spaced relation to create open drainage channels between the bottom ends of the void forms, while simultaneously laying down a vapour/air/radon barrier in the form of the product's upper sheet. Meanwhile, the flexible upper sheet of the product allows compact storage and transport thereof in rolled or folded form, for easy placement of the strips by unrolling or unfolding of same across the floor surface. Through preferable use of recycled foam, the environmental impact of the product is also reduced compared to non-recycled polystyrene void forms of the prior art, while avoiding the premature degradation pitfalls of cardboard void forms.

FIG. 10 shows an alternative to the first embodiment underlayments of FIGS. 1 through 6. In this alternate embodiment of the underlayment 110, instead of being composed solely of flexible vapour barrier sheeting that enables rolled-up storage and transport of the underlayment, the upper vapour barrier layer instead has a composite construction formed by a relatively rigid primary upper sheet 114 and a series of flexible perimeter flaps 115*a*, 115*b*, 115*c*, 115*d* affixed to the primary upper sheet 114 in a manner spanning fully around the outer perimeter thereof in overhanging relation therefrom. These flexible perimeter flaps comprise the same substantially impermeable plastic sheeting or other material as the upper sheet 14 of the first embodiment, and thus define the same flexible, overhanging outer margins by which multiple underlayments can be overlapped and sealed together during installation, as described above for the first embodiment where such flexible outer margins are seamlessly integral parts of the same flexible sheeting overlying the foam insulation bodies 112. Like with the first embodiment, one or more lower sheets 116 preferably encapsulate the foam insulation bodies in a manner wrapping around the lower ends thereof and tucking up into sealed connection with the upper vapour barrier layer, in this case at the underside of the primary upper sheet 114, at the top ends of the drainage spaces 118.

The primary upper sheet 114 in the alternate embodiment is more rigid than the plastic sheeting or material used for the perimeter flaps 115, but is likewise substantially impermeable to gas and vapour, just like the more flexible plastic sheeting of the perimeter flaps. In one non-limiting example, the primary sheet 114 may be a sheet of puckboard (High Density Poly Ethylene, or HDPE) or other rigid or semi-rigid plastic, and may measure between 2×2 feet and 6×12 feet, for example measuring 4×8 feet in one particular instance. Use of puckboard other non-porous, impermeable rigid sheeting serves the dual-purpose of replacing the vapour barrier functionality of the flexible upper sheet of the first embodiment, and also replacing the concrete load-distributing functionality of the separate cover 40 installed atop the underlayments in the first embodiment. The relatively rigid primary sheet of the second embodiment thus avoids the need to install a separate cover layer after placing the underlayments over the floor surface, while the flexible perimeter flaps still enable the same adjustable overlap and seamed-together attachment of the underlayments during installation.

While the relatively rigid primary sheet 114 in the alternate embodiment prevents rolled storage and transport, FIG. 12 illustrates how the sizing, shape and relative spacing of the foam insulation bodies 112 may be selected to enable intermeshed stacking of two matching underlayments, thereby minimizing the stacked height of two or more underlayments in storage or transport. In the illustrated example, the drainage spaces 118 between the foam insulation bodies 112 are of similar size and shape, but inverted orientation, relative to the foam insulation bodies themselves. Accordingly, as shown in FIG. 12, a first underlayment can be laid out in an inverted (upside-down) orientation facing its foam insulation bodies upward so that a second underlayment can be laid atop the first in a non-inverted (right-side-up) orientation in a position longitudinally offset from the first underlayment by one body width $W_B$ so that the downwardly protruding foam insulation bodies of the second underlayment are received in intermeshing relation between the foam insulation bodies of the first underlayment. In this invertedly and intermeshingly stacked relationship of the two underlayments, where the foam insulation bodies of each underlayment point toward the rigid primary sheet of the other underlayment inside the drainage spaces of that other underlayment, the distance between the primary sheets 114 of the two underlayment is minimized to the keep the stacked height thereof to a minimum.

It will be appreciated that the same use of intermeshably shaped foam insulation bodies may be employed for space efficient stacking of underlayments regardless of whether the upper vapour barrier layer of the underlayments includes a relatively rigid primary sheet, like that of the second embodiment, or features a flexible sheet composition throughout, like that of the first embodiment. The flexible outer flaps in the second embodiment may be narrow strip-like flaps individually attached and sealed to the primary upper sheet 114 along the respective perimeter edges thereof, and then sealed together at the corners of the primary upper sheet to ensure a gas and vapour tight state throughout to entire area of the resulting composite vapour barrier layer. Alternatively, the flaps may be integral parts of a unitary flexible sheet that overlies or underlies the more rigid primary sheet 114, and exceeds the size of the primary sheet 114 so as to overhang therefrom on all perimeter sides thereof to define the flexible outer margins by which the underlayment can be sealed to another such underlayment.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. In combination with an earthen floor surface of an excavated area and a concrete foundation slab overlying said earthen floor surface, at least one concrete foundation slab underlayment residing overtop of said floor surface and beneath said concrete slab, said underlayment comprising:

an upper vapour barrier layer that comprises at least one material that is substantially impermeable to gas and vapour, and that resides in underlying adjacency to the concrete foundation slab; and a set of insulation bodies that are materially distinct from the at least one material of the upper vapour barrier layer, and are secured to said upper vapour barrier layer in underlying relation thereto at a central non-margin area thereof such that said insulation bodies reside oppositely of the concrete foundation slab across said upper vapour barrier layer;

a cover layer residing atop the underlayment and beneath the concrete foundation slab, wherein the cover layer is more rigid than said flexible sheeting of the upper vapour barrier layer and resides in overlying relation to the upper vapour barrier layer and the insulation bodies therebeneath, wherein:

said upper vapour barrier layer spans fully over all of said insulation bodies, said insulation bodies are spaced apart from one another at least at lower ends thereof that reside opposite of the upper vapour barrier layer in offset relation therefrom nearer to the earthen floor surface, thereby leaving drainage/air spaces open between the lower ends of said insulation bodies beneath the concrete foundation slab and the upper vapour barrier and overtop of the earthen floor surface; and said at least one material of the upper vapour barrier layer comprises flexible sheeting, at least at outer margins of said upper vapour barrier layer that reside along respective perimeter edges of the vapour barrier layer outside the central non-margin area occupied by the insulation bodies; and the combination further comprises a cover layer that resides atop the underlayment and beneath the concrete foundation slab, is more rigid than said flexible sheeting of the upper vapour barrier layer, and resides in overlying relation to the upper vapour barrier layer and the insulation bodies therebeneath;

whereby the upper vapour barrier layer forms a gas and moisture barrier beneath said concrete foundation slab, and the insulation bodies and the drainage/air spaces therebetween form a combination of void spaces, drainage channels and insulation blocks overtop of said earthen floor surface and beneath said concrete foundation slab and said upper vapour barrier layer.

2. The combination of claim 1 wherein the insulation bodies are encapsulated between said vapour barrier layer and at least one flexible lower sheet wrapped about the lower ends of said insulation bodies.

3. The combination of claim 1 wherein each insulation body is elongated in a longitudinal body direction, and a width dimension of the upper vapour barrier layer in the longitudinal body direction exceeds a length dimension of each insulation body in said longitudinal body direction.

4. The combination of claim 3 wherein two of the outer margins of the upper vapour barrier layer reside outside the central non-margin area at opposite sides thereof in the longitudinal body direction.

5. The combination of claim 1 wherein the outer margins of the upper vapour barrier layer surround the central non-margin area thereof on all sides.

6. The combination of claim 1 wherein said insulation bodies comprise foam.

7. The combination of claim 1 wherein the drainage/air spaces between the insulation bodies are unobstructed spaces sized and shaped to accommodate stacked receipt of the insulation bodies of a matching underlayment.

8. The combination of claim 1 wherein the cover layer comprises sheets or panels that comprises wooden material.

9. The combination of claim 1 further comprising a sump pit recessed below said earthen floor surface and toward which water flow is gravitationally encouraged via the drainage spaces between the insulation bodies of the underlayment.

10. The combination of claim 1 further comprising a ventilation pipe, wherein the drainage spaces communicate with one another to collectively form an air space between the earthen floor surface and the underlayment, and the ventilation pipe communicates with said air space to exhaust gases therefrom.

11. The combination of claim 1 wherein the at least one underlayment comprises a plurality of underlayments residing overtop of said earthen floor surface and beneath said concrete foundation slab, wherein the said plurality of underlayments are sealed together with one another at the outer margins of the vapour barrier layers thereof to form a gapless span of said vapour barrier layers across said earthen floor surface.

12. The combination of claim 11, wherein the vapour barrier layers are sealed together by heat welded seams.

13. The combination of claim 1 wherein the at least one underlayment comprises a plurality of underlayments each residing overtop of said floor surface and beneath said concrete foundation slab, wherein said plurality of underlayments comprise differently dimensioned underlayments among which a thickness dimension of the insulation bodies measured from the lower ends thereof to the vapour barrier layer varies from one underlayment to another, and said differently dimensioned underlayments reside next to one another atop a sloped surface of the excavated area in order of decreasing thickness from a lower elevation on said sloped surface toward a higher elevation on said sloped surface to reduce elevational offset between the vapour barrier layers of said underlayments due to said sloped surface.

14. In combination with an earthen floor surface of an excavated area and a concrete foundation slab overlying said earthen floor surface, at least one concrete foundation slab underlayment residing overtop of said floor surface and beneath said concrete slab, said underlayment comprising:

an upper vapour barrier layer that comprises at least one material that is substantially impermeable to gas and vapour, and that resides in underlying adjacency to the concrete foundation slab; and a set of insulation bodies that are materially distinct from the at least one material of the upper vapour barrier layer, and are secured to said upper vapour barrier layer in underlying relation thereto at a central non-margin area thereof such that said insulation bodies reside oppositely of the concrete foundation slab across said upper vapour barrier layer;

a cover layer residing atop the underlayment and beneath the concrete foundation slab, wherein the cover layer is more rigid than said flexible sheeting of the upper vapour barrier layer and resides in overlying relation to the upper vapour barrier layer and the insulation bodies therebeneath, wherein:

said upper vapour barrier layer spans fully over all of said insulation bodies, said insulation bodies are spaced apart from one another at least at lower ends thereof that reside opposite of the upper vapour barrier layer in offset relation therefrom nearer to the earthen floor surface, thereby leaving drainage/air spaces open between the lower ends of said insulation bodies beneath the concrete foundation slab and the upper vapour barrier and overtop of the earthen floor surface;

said at least one material of the upper vapour barrier layer comprises flexible sheeting, at least at outer margins of said upper vapour barrier layer that reside along respective perimeter edges of the vapour barrier layer outside the central non-margin area occupied by the insulation bodies; and the vapour barrier layer comprises a primary upper sheet that has greater rigidity than the flexible sheeting and occupies the central non-margin area at which the insulation bodies are secured, and a set of flexible perimeter flaps that are formed of said flexible sheeting, are attached directly to the primary upper sheet, and span in overhanging relation therefrom around a perimeter thereof at said outer margins of said vapour barrier layer;

whereby the upper vapour barrier layer forms a gas and moisture barrier beneath said concrete foundation slab, and the insulation bodies and the drainage/air spaces therebetween form a combination of void spaces, drainage channels and insulation blocks overtop of said earthen floor surface and beneath said concrete foundation slab and said upper vapour barrier layer.

15. The combination of claim 1 wherein the upper vapour barrier consists entirely of said flexible sheeting.

16. The combination of claim 14 wherein the insulation bodies are encapsulated between said vapour barrier layer and at least one flexible lower sheet wrapped about the lower ends of said insulation bodies.

17. The combination of claim 14 wherein each insulation body is elongated in a longitudinal body direction, a width dimension of the upper vapour barrier layer in the longitudinal body direction exceeds a length dimension of each insulation body in said longitudinal body direction, and two of the outer margins of the upper vapour barrier layer reside outside the central non-margin area at opposite sides thereof in the longitudinal body direction.

18. The combination of claim 14 wherein the outer margins of the upper vapour barrier layer surround the central non-margin area thereof on all sides.

19. The combination of claim 14 wherein said insulation bodies comprise foam.

20. The combination of claim 14 wherein the drainage/air spaces between the insulation bodies are unobstructed spaces sized and shaped to accommodate stacked receipt of the insulation bodies of a matching underlayment.

21. The combination of claim 14 wherein the primary upper sheet comprises puckboard.

22. The combination of claim 14 further comprising a sump pit recessed below said earthen floor surface and toward which water flow is gravitationally encouraged via the drainage spaces between the insulation bodies of the underlayment.

23. The combination of claim 14 further comprising a ventilation pipe, wherein the drainage spaces communicate with one another to collectively form an air space between the earthen floor surface and the underlayment, and the ventilation pipe communicates with said air space to exhaust gases therefrom.

24. The combination of claim 14 wherein the at least one underlayment comprises a plurality of underlayments residing overtop of said earthen floor surface and beneath said concrete foundation slab, wherein the said plurality of underlayments are sealed together with one another at the outer margins of the vapour barrier layers thereof to form a gapless span of said vapour barrier layers across said earthen floor surface.

25. The combination of claim 24, wherein the vapour barrier layers are sealed together by heat welded seams.

26. The combination of claim 14 wherein the at least one underlayment comprises a plurality of underlayments each residing overtop of said floor surface and beneath said concrete foundation slab, wherein said plurality of underlayments comprise differently dimensioned underlayments among which a thickness dimension of the insulation bodies measured from the lower ends thereof to the vapour barrier layer varies from one underlayment to another, and said differently dimensioned underlayments reside next to one another atop a sloped surface of the excavated area in order of decreasing thickness from a lower elevation on said sloped surface toward a higher elevation on said sloped surface to reduce elevational offset between the vapour barrier layers of said underlayments due to said sloped surface.

* * * * *